US010198972B2

(12) United States Patent
Basset et al.

(10) Patent No.: US 10,198,972 B2
(45) Date of Patent: Feb. 5, 2019

(54) LIGHTGUIDE TAMPER SEAL

(71) Applicant: CSEM CENTRE SUISSE D'ELECTRONIQUE ET DE MICROTECHNIQUE SA—RECHERCHE ET DÉVELOPPEMENT, Neuchâtel (CH)

(72) Inventors: Guillaume Basset, Huningue (FR); Marc Schnieper, Onex-Genève (CH)

(73) Assignee: CSEM CENTRE SUISSE D'ELECTRONIQUE ET DE MICROTECHNIQUE SA—RECHERCHE ET DÉVELOPPEMENT, Neuchatel (CH)

( * ) Notice: Subject to any disclaimer, the term of this patent is extended or adjusted under 35 U.S.C. 154(b) by 0 days.

(21) Appl. No.: 15/907,075

(22) Filed: Feb. 27, 2018

(65) Prior Publication Data

US 2018/0190159 A1 Jul. 5, 2018

Related U.S. Application Data

(63) Continuation of application No. 15/021,235, filed as application No. PCT/EP2014/069549 on Sep. 12, 2014, now abandoned.

(30) Foreign Application Priority Data

Sep. 13, 2013 (WO) ..... PCT/EP2013/069069

(51) Int. Cl.

| | |
|---|---|
| ***G09F 3/03*** | (2006.01) |
| ***B65D 55/02*** | (2006.01) |
| ***B65D 55/06*** | (2006.01) |

(52) U.S. Cl.

CPC ..... *G09F 3/0376* (2013.01); *B65D 55/026* (2013.01); *B65D 55/066* (2013.01)

(58) Field of Classification Search

CPC ..... G02B 6/16

(Continued)

(56) References Cited

U.S. PATENT DOCUMENTS 4,447,123 A * 5/1984 Page ..... G02B 6/2804 250/227.15
4,729,626 A * 3/1988 Stieff ..... G09F 3/0376 340/541

(Continued)

FOREIGN PATENT DOCUMENTS

DE 10 2008 013 690 A1 9/2009
EP 0 329 263 A2 8/1989

(Continued)

OTHER PUBLICATIONS

International Search Report dated Nov. 21, 2014, issued in corresponding International Application No. PCT/EP2014/069549, filed Sep. 12, 2014, 5 pages.

(Continued)

*Primary Examiner* — Kaveh C Kianni
(74) *Attorney, Agent, or Firm* — Christensen O'Connor Johnson Kindness PLLC

(57) ABSTRACT

A tamper seal includes an optical waveguide arranged to guide a propagating light-beam along a propagation direction. First and second portions of the tamper seal are configured to be arranged on first and second parts, respectively, which are movable relative to each other. The first portion has an input coupler arranged to couple incident light into the optical waveguide, and the second portion has at least one output coupler arranged to couple out of the optical waveguide at least partially light guided in the optical waveguide. The input coupler, the optical waveguide, and the output coupler are configured to transmit light from the input coupler to the output coupler. The waveguide is configured to be disruptable and includes a layer having (Continued)

a distinctive appearance that is changed in response to an at least partial disruption of said optical waveguide.

21 Claims, 1 Drawing Sheet

(58) Field of Classification Search
USPC ..... 385/13
See application file for complete search history.

(56) References Cited

U.S. PATENT DOCUMENTS 4,883,054 A * 11/1989 Fuller ..... G01M 11/31 606/12
5,507,378 A * 4/1996 Leone ..... G07F 9/06 194/202
6,304,713 B1 * 10/2001 Isogai ..... G06K 9/00 250/227.15
2005/0179548 A1 * 8/2005 Kittel ..... G06K 19/07798 340/568.2
2005/0190914 A1 * 9/2005 Chen ..... G06K 19/08 380/201
2005/0231365 A1 * 10/2005 Tester ..... G06K 19/07798 340/568.1
2009/0051562 A1 * 2/2009 Potter ..... G08B 21/0286 340/693.5
2014/0252032 A1 * 9/2014 Corbett ..... B65D 25/18 222/105
2017/0224063 A1 * 8/2017 Chadwick ..... A44B 99/00

FOREIGN PATENT DOCUMENTS

EP 0 955 621 A2 11/1999
JP 2002 019338 A 1/2002
JP 2002019338 A * 1/2002
WO 2011/072405 A1 6/2011

OTHER PUBLICATIONS

Written Opinion dated Nov. 21, 2014, issued in corresponding International Application No. PCT/EP2014/069549, filed Sep. 12, 2014, 5 pages.

* cited by examiner

LIGHTGUIDE TAMPER SEAL

CROSS-REFERENCES TO RELATED APPLICATIONS

This application is a continuation of U.S. application Ser. No. 15/021,235, filed Mar. 10, 2016, which is a National Stage of WOSN PCT/EP2014/069549, filed Sep. 12, 2014, which is based on WOSN PCT/EP2013/069069, filed Sep. 13, 2013, the disclosures of which are hereby expressly incorporated by reference herein in their entirety.

FIELD OF INVENTION

The invention relates to the field of tamper seals for the detection of fraudulent manipulation and counterfeit of valuable goods or products. The invention is more particularly related to the field of visual or electromagnetic tamper seals.

BACKGROUND

Counterfeiting is seriously damaging for the customer, who may become deceived, and it is especially damaging for the industry as the products lose prestige, and brands can lose important amounts of their turnover due to these kinds of fraudulent practices. In specific cases such as chemicals and beverages, counterfeiting can also lead to severe security and health risks.

Proving if a product is genuine has been a continuous field of investigation. For more than a century, tamper evident seals has been designed with increasing complexity to avoid the sale of containers, envelopes, bottles and boxes with the unintended content. The target of a tamper seal is to show explicitly whether a first opening of a container has been done and to prevent the reuse of such container with non-genuine content.

Investigation to detect the opening of boxes or envelopes can be tracked back to the use of increasingly sophisticated wax seal. To prevent the re-use of container such as bottles, have led to investigation since many decades, e.g. GB191321357 or U.S. Pat. No. 1,038,023. Technical solutions difficult to counterfeit need to be renewed with technical progress and this field is in a constant evolution.

In a different field in the last decade new solutions have been proposed to secure security document such as passports, credit cards or banknotes by incorporating in the laminate structures optical waveguides or similarly called lightguides, which may be combined with zero-order filters or other security devices. These difficult to reproduce additional distinctive elements increase the complexity of such documents and are visually distinctive by machine vision or human eye, preventing forging of these documents. An example of these possibilities is disclosed in WO2011/072405. In this case an optical waveguide is used having specific optical features that can be recognised and the optical security device has to survive throughout the lifetime of the object in or on which it is adapted. It is not designed and engineered to be sensitive to changes in the environment but on the opposite to stay unchanged despite external stresses and aggressions.

Example of markets where products are sold thanks to the recognition of the packaging by the consumers, and not of its content, are the market of perfumes, pharmaceutics and high value alcoholic beverages, such as quality wine and spirits. For these markets, it is critical for the manufacturers to have distinctive packaging that counterfeiters cannot forge and copy easily and that cannot be re-used easily either. However, perfumes and alcoholic beverages are sold in jars and bottles that in most cases can be reused as the emptying of their content rarely lead to their destruction. Counterfeiting networks of beverages for example devote themselves to fill authentic bottles of known brands, with low-quality beverages and to re-capsulate them before selling said counterfeit bottles at below their usual price, many times also in the official channel, with the subsequent damage for the brands. From the packaging, it is only the capsule, which in some cases could distinguish them from genuine products. The same problem exists in the case of chemical or medical substances with an even higher danger, i.e. counterfeiting of the substances could lead to extremely severe security and health problems, as there is no control or hygiene in the counterfeiting business. The development of anti-counterfeit techniques and systems is an important industry sector as most brands attempt to protect themselves against this important fraud and some of them even invest up to 5% of their turnover both in anti-counterfeiting systems and components, and in undertaking legal actions.

Some security elements are the tags and seals surrounding both the bottle and the bottleneck. They can incorporate different security elements: security bottoms, encoded printing, iridescent printing, rosettes, anti-scanner and anti-photocopy colors, neutral response to ultraviolet light, luminescent fibers and ink that is only visible by means of its exposure to ultraviolet light, latent image, micro text, phosphorescent inks or even DNA code prints, allowing to certify the authenticity of extremely highly priced products). One of the drawbacks of security tags or seals is that they do not easily prevent the products from being counterfeited because they can be reproduced quite faithfully, without the consumer being able to detect the fraud or due to the fact that the original tags can be easily removed although special glues are used to stick them.

As counterfeiters constantly acquire new skills and technology, more and more complex solutions are put in place in this tamper seals. Simple printed elements adapted to bottle capsules such as reported in CA2398089 in FR2918966 are replaced with more complex systems such as reported in EP1857374, as example among many others. EP1857374 discloses for example a radiofrequency identification element, or RFID tag, adapted to a bottle cap and a separate radiofrequency detector. Any rupture or damage of the bottle part on which the RFID tag is adapted will cause destruction or malfunction in the detected radiofrequency signal, and so allows the detection of fraudulent manipulations. EP1857374 illustrates that these types of solutions are complex and not user-friendly for the average consumer, they are expensive and require specific readout equipment (a UV lamp or an RFID detector system for example).

Another example of a tamper seal presenting visible changes that indicate tampering attempts through delamination of a light diffusive layer is explained in US2004/0209028. The appearance of an optical seal such as disclosed in US2004/0209028 may lack a unique appearance feature or a specific function preventing forgers to replace such seals with forged labels having a similar overall appearance. Especially poor lighting conditions are possible in the retailing shops, or in the consumption establishments for the alcoholic beverages and the consumers may have limited access to information of how the packaging should look like.

For some applications such as for container locks, as disclosed in US 2008/0256991, a system has been proposed based on an optical waveguide wherein at one side an infrared emitter is arranged and wherein to the other end of the optical waveguide an infrared detector is incorporated. The detection of infrared light by the detector is used to detect for example attempts to break into the container or to detect that the container is locked in a proper way. Such a system is voluminous and it would be very difficult to miniaturise it and to adapt it to smaller objects such as bottles or small containers. Also, the system requires a light emitter and so also an energy source for that emitter, and the solution would also not be conceivable as anti-counterfeit for smaller and less expensive objects.

Another example of a system using an optical waveguide is disclosed in JP2002019338. This system is based on a monomode waveguide or a stack of monomode waveguide layers. As mentioned in JP2002019338, this system has various limitations. In this system, the plane wave from a laser is incoupled into a monomode waveguide thanks to a so-called light binding hologram (or a plurality of these holograms). The hologram in JP2002019338 is basically a grating patterning the monomode waveguide surface and can be called as well a resonant waveguide grating. JP2002019338 mentions in par.[0026] that the light source that can be used to control the seal must be a laser, preferably a visible-light laser. It must have a coherence length of several mm or more so that it constitutes substantially a plane wave impeding on the binding hologram [0031].

Using materials having common refractive indexes (~1.5), as suggested in JP2002019338, the monomode waveguide core must have a thickness of 2.4 μm or less (see par. [0005]). The monomode waveguide core must be surrounded by two claddings having thicknesses of 6 μm or more to avoid cross-talks between monomode cores or light leakage by a fraction of the light escaping the waveguide (see par. [0005]). As the light-binding holograms require a coherent laser to be coupled to the monomode waveguide, only a monochromatic light source can be used which means that light sources such as sunlight, light bulbs, LEDs and other non monochromatic light sources cannot be used in the seal described in JP2002019338. This implies the requirement of an extremely precise alignment of the incident light beam to the light-binding holograms, as non-normal incidence will not couple light into the monomode waveguide. The required alignment precision of the incident angle of the impeding light beam on the hologram should be typically better than 2°, relative to the normal of to said light binding holograms. This could prove difficult in practical use to test infringement as tamper-evident seals can be used on objects of any shape and size. In consequence a very precise and complicated alignment system must be provided, or at least an alignment system must be designed and/or adapted for each differently shaped object to which a tamper-evident seal is fixed. More particularly, it would be extremely difficult, if not impossible, to hold by hand a laser source and perform the required illumination alignment precision of the incident light beam to the light-binding holograms in the system of JP2002019338.

Additionally, as the tamper seal proposed by JP2002019338 is designed to work with monomode waveguide(s), the identification and therefore the security of the seals relies in using several laminated monomode waveguides working at different laser wavelengths, or in using a spatially phase-modulated laser beam (also-called uneven beam or unevenness of the light-binding holograms). This in turns requires the modulated light to be aligned to the modulation of the unevenness of the light-binding holograms, either placed in the grating itself or in the cladding. The order of magnitude for this spatial phase modulation cited in JP2002019338 is between a few microns and a few tens of microns. Therefore, in order to control a seal, a trained professional must be equipped with the right laser (or different lasers and perform iteratively different controls) equipped with the right phase modulation optics and shine the laser (or the lasers) on a target of a milllimetric-range size, and he must align the laser source to invisible micron-size patterns and with an accurately normal incidence. In most anti-counterfeiting control situations, which can happen in hostile environment or must be performed in very limited timeframe, this would be highly impractical or in practice impossible to perform. Only trained and well-equipped professionals could perform such a control.

SUMMARY

The object of this invention is to overcome at least partially the limitations of the anti-counterfeit devices described in the prior art, and thereby to provide a tamper seal to improve the detection of fraudulent manipulation and counterfeit of valuable objects, products or consumable goods. In particular, it is an object of the current invention to provide a multimode lightguide seal that can be controlled and identified by using easily available low coherence light-sources, by any untrained consumer as well as by professional controllers.

More specifically the invention relates to a tamper seal comprising an optical multimode waveguide, also called in this specification multimode waveguide or optical waveguide or waveguide, being preferably a flexible optical waveguide, comprising a first portion and a second portion, intended to be respectively arranged on a first part and a second part of an object, said first and second parts being movable to each other. The optical multimode waveguide is a highly multimode waveguide comprising at least a multimode waveguide core, also called core, having a core thickness of at least greater than 10 μm and smaller than 10 mm, said core thickness being defined perpendicular to the light-beam propagating into the multimode waveguide.

The first portion of the optical waveguide comprises an incoupling surface to which an input coupler is arranged to couple incident light on the input coupler into the optical waveguide. The optical waveguide comprises further an outcoupling surface arranged to couple at least a portion of the guided light out of the optical waveguide. The input coupler, the optical waveguide and the outcoupling surface are arranged to transmit light from the input coupler to the outcoupling surface.

When the two parts of the object undergo a relative displacement, the optical waveguide of the tamper seal is at least partially destroyed, disrupted or broken, at least a portion of the light guided by the optical waveguide escapes the optical waveguide and is not completely transmitted to the second portion and to the outcoupling surface of the optical waveguide, so that at most only a small portion of the light may be transmitted from the input coupler to the outcoupling surface.

A critical transmission by the guidance of light in the optical waveguide can be realized by specific design and engineering wherein specific colours or modes are prevented from propagation or wherein said colors or modes have a low intensity. Many different customizations can be designed to make the appearance of the out-coupled light visually distinctive, in terms of logos or texts, colors, out-coupling angles or fluorescence. The use of highly multimode optical waveguides allows transporting low-coherence light as well as transporting light-beams having a large frequency bandwidth, or polychromatic light beams.

The many different modes that propagate at many different angles in the core of said multimode waveguides allow creating an infinite variation of identities for the tamper seals. The human eyes as wells as the electronic imaging system designed for imaging are highly sensitive to color and/or intensity variations, and various images of various colors and shapes, or combination of images, can very efficiently provide identity information that delivers authenticity and identification of tamper seals using highly multimode waveguides. Such highly multimode waveguides can as well be designed to be controlled using specific illumination conditions, such as specific frequency of UV light, IR light or visible light (substantially monochromatic sources) and/or collimated sources to produce specific optical signatures. A tamper-seal based on a highly multimode waveguide can provide different optical signatures when illuminated with different illumination conditions. These different conditions could be different low coherence light sources or using the same light-source but illuminating at different angles/locations. Such controls of the tamper-seal could be done for example with a white LED-flash lamp of a smartphone or a light source from the immediate environment (building illumination, sunlight).

The optical waveguide may comprise at least one portion that is mechanically weakened in order to facilitate the at least partial disruption of the optical waveguide. This allows improving the sensitivity level of the tamper seal.

A tamper seal according to the invention is extremely sensitive to any rupture, breakage or any partial damage, at any place along the optical waveguide because the guided light in the optical waveguide will undergo changes of its intensity and/or color and/or outcoupling angle and spatial distribution. The loss of a high quality or very specific optical transmission from said first portion to said second portion of the optical waveguide is irreversible, as it is extremely difficult to re-establish completely the waveguiding properties of the optical waveguide without proper equipment. Restoring an at least partially disrupted optical waveguide is extremely difficult and producing such a tamper seal requires huge investments and complicated technologies. The tamper seal according to the invention is therefore extremely efficient and valuable as a detection means of counterfeit of the object to which it is arranged.

According to an embodiment of the invention the outcoupling surface comprises an output coupler, preferably arranged to the incident light side of the optical waveguide. The arrangement of an output coupler, on the outcoupling surface allows coupling even more efficiently the light out of the optical waveguide. The preferable arrangement of the output coupler to the incident light side of the optical waveguide, or to the side opposite to it, also allows having a larger available surface on which it is easier to adapt a layer such as a colored layer, a fluorescent layer, a diffusion layer and/or a security device.

The optical waveguide of the tamper seal is made preferably of a flexible material and has preferably a ribbon shape or a fibre shape and is preferably made of polymer or glass or of a water soluble polymer such as Polyvinylpolypyrrolidone or Polyvinyl alcohol, or any combination of these materials. The input and/or output coupler of the tamper seal is preferably made partially in a water-soluble polymer such as Polyvinylpolypyrrolidone or Polyvinyl alcohol. The use of these types of flexible materials allows arranging the tamper seal on objects having a complex shape, to make such devices at low cost and to make such devices sensitive to their environment. It is especially useful to detect attempts to remove the tamper seal from at least one of the two movables parts of the object.

According to some embodiments the input coupler and/or the output coupler may be arranged either to the incident light side of the optical waveguide or to the opposite side of that side, and according to some embodiments at least one of the input coupler or the output coupler may be integrated in the optical waveguide, preferable optically close to the optical waveguide surface. This allows protecting the input coupler and/or the output coupler.

According to another embodiment the optical waveguide comprises at least one cladding layer. This allows avoiding light transmission losses in the waveguide as well as protecting the optical waveguide from moisture, unwanted damage or avoids stray light that might enter or exit in the optical waveguide on unwanted locations.

The tamper seal may comprise a temperature indicator responding irreversibly to heat, the temperature indicator being preferably located in or on a portion of the optical waveguide changing its optical guidance properties by heating this portion. This temperature indicator allows detecting attempts to remove the tamper seal from at least one of the two movables parts of the objet by heating up the seal or its immediate surroundings.

According to an embodiment a first layer may be arranged on the output coupler. The first layer may be an absorbing layer, preferably a layer comprising ink. The first layer may also be a scattering layer. The first layer may also comprise fluorescent substances or any pigmented layer changing the color of the outcoupled light. According to an embodiment a combination of such first layers are possible. The first layer may also comprise a security element such as a grating element, a zero-order filter, a hologram, a micro-lens array, a micro-prism array or any combination of them. According to another embodiment of the invention said first layer may also be arranged directly on the outcoupling surface when no output coupler is arranged to the outcoupling surface.

According to another embodiment at least a second layer, eventually similar to said first layer (arranged on the outcoupling surface or output coupler), may be arranged on at least a portion of the surface of the optical waveguide. The purpose of this second layer is to improve and enhance the counterfeit detection, by inducing additional optical effects upon any rupture of the optical waveguide. The second layer may be arranged on an optical waveguide with or without cladding. According to an embodiment the second layer will change the intensity or color of guided light into the cladding of the optical waveguide when the optical waveguide is at least partially disrupted. The second layer may be arranged at any position and at any portion of the surface on the optical waveguide. Arranging a second layer to the optical waveguide surface that influences the color of the guided light in the optical waveguide allows improving the difficulty of counterfeit and enhances the sensitivity of the optical effect of any disruption or damage of the optical waveguide or any part of the tamper seal. The second layer may as well be arranged on the cladding of the waveguide, at least on one of its portion. In a similar way, this second layer can change the color, mode, intensity or spatial distribution of the light guided on the waveguide cladding.

According to the invention the optical waveguide has a thickness of preferably 10 μm-10 mm, more preferably 20 μm to 500 μm. These typical dimensions of the optical waveguide allow arranging the tamper seal on a curved and complex shaped surface.

According to an embodiment the first or second order diffracted light is used to couple light efficiently into the optical waveguide. The efficient coupling of light according to the first and/or second diffraction order allows obtaining very specific color effects and also high intensity levels of these color effects, enhancing as such the sensitivity of the tamper seal and the protection level against counterfeit of the object to which the tamper seal is arranged.

According to an embodiment two outcoupling surfaces may be arranged on the optical waveguide and at least one of the outcoupling surfaces may comprise an outcoupling grating arranged on at least one of said outcoupling surfaces. The arrangement of more than one outcoupling surfaces, allows enhancing the optical effects of any damage of the tamper seal and as such the security level of the tamper seal.

In yet another embodiment the optical waveguide comprises at least two separate optical waveguides arranged to at least one input coupler. This allows adapting the tamper seal to complex shaped objects with eventually more than 2 relatively moveable parts.

The invention relates also to an object comprising a first part and a second part movable relative to each other, said first and second parts being sealed by a tamper seal, and said parts being each integral with, respectively, first and second portions of the optical waveguide of the tamper seal, so that a displacement of the first and second parts of the object generates at least a partial disruption of the optical waveguide. The object may be a bottle wherein the first part is the bottle and the second part the bottle cap, the bottle sleeve or the cork of the bottle The first portion of the optical waveguide is arranged on the bottle and the second portion of the optical waveguide is arranged on said bottle cap or the sleeve or the cork of the bottle. The arrangement of a tamper seal according to the invention on a bottle comprising a cork and a cap allows protecting the contents of the bottle against counterfeit. The seal can also be integrated within a foil or laminated on a foil which disruption is necessary to access or use the object, such as polymer protection sheets or sleeves. In this case, different parts of the foil or sleeve are moving relatively to each other upon disruption of the foil.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 1*d* illustrates a lateral view of the generic tamper seal comprising an optical waveguide on which a cladding layer is arranged;

FIG. 1*e* illustrates a lateral view of the generic tamper seal comprising a first layer arranged on the optical waveguide;

FIG. 1*f* illustrates a lateral view of the generic tamper seal comprising a first layer arranged on the optical waveguide;

FIG. 2*a* Illustrates a lateral view of a tamper seal comprising an output coupler arranged on the outcoupling surface;

FIG. 2*b* Illustrates a top view of a tamper seal comprising an output coupler arranged on the outcoupling surface;

FIGS. 3-5 illustrate variants of a tamper seal with different arrangements of input and output couplers arranged as reflection or transmission couplers;

FIG. 6 illustrates a tamper seal comprising an output coupler and an optical waveguide comprising a cladding material;

FIG. 7 illustrates another tamper seal comprising a first layer arranged on the output coupler, both imbedded in the optical waveguide comprising a cladding;

FIG. 8*a* illustrates a tamper seal comprising a second layer arranged on the cladding arranged on the optical waveguide;

FIG. 8*b* illustrates a lateral view of tamper seal comprising a second layer and a security element arranged on the optical waveguide;

FIG. 9 illustrates a top view of tamper seal comprising a second layer and a security element arranged on the optical waveguide;

FIG. 10 illustrates a tamper seal comprising a plurality of waveguides and light outcoupling surfaces;

FIG. 11 illustrates a tamper seal comprising two curved portion of the optical waveguide;

FIG. 12 shows some exemplary objects according to the invention.

DETAILED DESCRIPTION

Figure 1A:
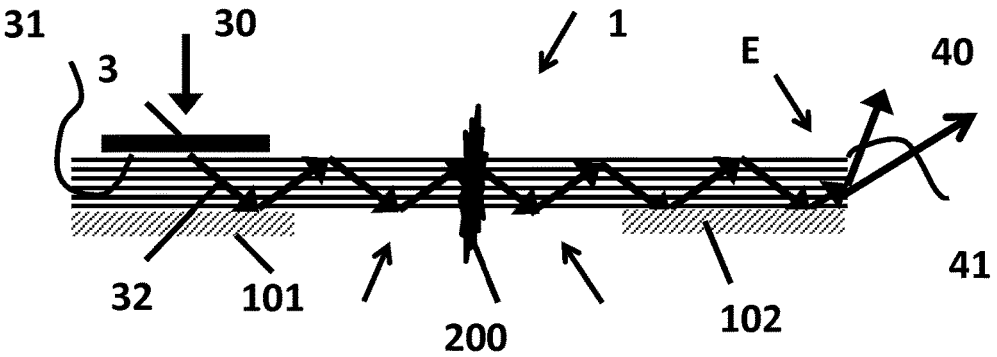
FIG. 1*a* illustrates a lateral view of the generic tamper seal comprising an optical waveguide with an input coupler and an outcoupling surface.

The following detailed description illustrates the principles and examples of embodiments according to the invention. It will thus be appreciated that those skilled in the art will be able to devise various arrangements that, although not explicitly described or shown herein, embody the outlined principles of the invention and are included in its scope as defined in the claims. In the description and the figures, similar reference signs refer to the same or similar components or structural elements. Also, the term "transparent" as used herein the description encompasses an average visible transparency of a light beam of at least 70%, for light of the wavelength of interest. The term "visible" as used herein means light between the near-UV to the near-infra-red, i.e. between 300 nm-2 μm as such wavelengths can be seen by human eye or can be easily converted to wavelengths visible to the human eye.

According to the invention, a tamper seal 1 comprises an optical waveguide 2 comprising at least two portions, a first portion 2A, called also the incoupling portion 2A, and a second portion 2B portion, called also the outcoupling portion 2B, of the optical waveguide 2. Said optical waveguide 2 is a multimode waveguide, the definition of which excludes monomode waveguides. Thus, monomode waveguides are not comprised in the present invention. Said optical waveguide 2 comprises at least a waveguide core, in which light is propagated by internal reflections. An example of such a core is a flat plastic sheet being surrounded by air. In such a flat plastic sheet light may propagate by total internal reflection at the interfaces of the plastic sheet and the air. Said core may have different cross section shapes and has a thickness greater than 10 μm, preferably greater than 20 μm, more preferably greater than 50 μm, said thickness being defined perpendicular to the propagation direction of the guided light and in the thinnest part of the cross section of that core. Said thinnest part corresponds to the smallest dimension of the waveguide core. The shape of the cross section of the core may vary along the propagation direction of the propagating light beam. For example the core may be a tapered core. In another example the core has a rectangular cross section at one end and a different rectangular cross section at its other end. The thinnest part of the cross section of said waveguide core has a dimension smaller than 10 mm. For example a waveguide core may have a rectangular cross section dimension of 10 μm×100 μm, or 10 μm×2 mm, or 10 mm×20 mm, or 10 mm×30 mm. In another example a waveguide core may have an elliptical cross section having dimensions of the smallest diameter x greatest diameter of 10 μm×100 μm, or 10 μm×2 mm, or 10 mm×20 mm, or 10 mm×30 mm In another example a multimode waveguide having a circular shaped core may have a core diameter between 2 μm and 10 mm. The dimension limitations are imposed only for the core of the multimode waveguide and do not apply to the external dimensions of the waveguide comprising a cladding or any other layer adapted to the core of the waveguide. Optical waveguides guiding UV, or visible or near IR light and having a core cross section dimension of at least 10 μm are also called highly multimode waveguides as they guide a great number of modes. The core of an optical multimode waveguide and the propagation of light in the core of a multimode waveguide, as well as multimode waveguides that have no cladding layer is well described in the literature and will not be further commented here.

Said two portions are arranged, preferably by attachment elements 101-102, respectively to a first part 110 and a second part 120 of an object 100, said parts being movable to each other. The first and second parts 110,120 of the object 100 can be linked structurally together before being moved to each other, such as two parts of a foil, of a polymer sleeve or of a packaging element that will be partially disrupted and moved at a first opening. When said parts undergo a relative movement the optical waveguide 2 is at least partially disrupted and changes at least partially its optical guidance properties, usually losing this property. The arrangement of the optical waveguide 2 to the object parts 110,120 is not necessarily done below the optical waveguide 2 such as illustrated in the figures but can be done above it with a transparent medium for example laminated to the optical waveguide 2 or its cladding or by attachment elements which are not covering its whole surface.

According to a generic embodiment of the invention, illustrated in FIGS. 1*a* the incoupling portion 2A of the optical waveguide 2 comprises an incoupling surface 31 on which an input coupler 3 is arranged to the incident light 30 side of said optical waveguide 2, allowing to couple incident light 30 on that input coupler 3, inside the optical waveguide 2. The input coupler 3 may be a grating input coupler, comprising a plurality of grating elements. The input coupler 3 may comprise any type of incoupling structure, for example a refractive Fresnel microstructure. The optical waveguide 2 may be a ribbon optical waveguide 2 realized with a flexible material, transparent to visible light, arranged to transmit the incoupled light 32 in the optical waveguide 2 by total internal reflections through the optical waveguide 2 to the outcoupling surface 41 of the optical waveguide 2. In the generic embodiment of FIG. 1 the optical waveguide 2 has no cladding, and is preferably surrounded by air, and is substantially made of a single transparent material, preferably a flexible polymer, or thin glass or a fiber or fiber bundle, preferably at least partially, but not limited to water soluble polymer such as Polyvinylpolypyrrolidone or Polyvinyl alcohol, or any combination of these materials.

In the generic embodiment of FIG. 1*a*, said incoupling portion 2A and said outcoupling portion 2B of the tamper seal are intended to be attached to said parts 110,120 of the above mentioned object 100 by attachment means 100 which may comprise a gluing layer, a laminated adhesive or a mechanical attachment. It is obvious to the person skilled in the art that a wide variety of techniques exist that allow to arrange or to fix a tamper seal comprising a flexible optical waveguide 2 to any object 100 without damaging the tamper seal. Preferably the attachment of the said two portions 2A, 2B is realized substantially at the portions of the optical waveguide 2 where the incoupling surface 31 and the outcoupling surface 41 are arranged on the optical waveguide 2. The tamper seal 1 may also be attached to the object 100 at more than two attachment locations. For example, the tamper seal 1 may be additionally attached to the object 100 at a portion of the optical waveguide 2 located in between the incoupling surface 31 and the outcoupling surface 41 of the optical waveguide 2.

In a preferred variant of the generic embodiment of FIG. 1*a* the optical waveguide 2 has no cladding layer and has a cross section perpendicular to the propagation direction of the internal reflected light in the optical waveguide 2, which is substantially rectangular. Perpendicular to the propagating light direction in the optical waveguide, the optical waveguide 2 may have dimension (i.e. thickness×width) of 10 μm×10 mm, preferably 20 μm×500 μm. The optical waveguide 2 may be a fiber optical waveguide having a substantially circular or elliptical core cross section and may have a diameter between 10 μm-500 μm, preferably 20 μm-150 μm.

In the generic embodiment of FIG. 1*a,* the light is transmitted and guided by the optical waveguide 2 from said incoupling surface 31 to said outcoupling surface 41, and said transmitted light will be outcoupled by said outcoupling surface 41 and leave the tamper seal as a substantially diverging light beam 40. The outcoupling surface 41 may be arranged at any side of the extremity of the optical waveguide 2 and may be for example a polished edge realized at the extremity of the optical waveguide 2, as illustrated in FIG. 1*c*, so that the outcoupled light beam 40 is a diverging light beam directed to a predetermined direction. The outcoupling surface 41 may be partially roughened to create a diffusing and diverging light beam leaving the optical waveguide 2. The outcoupling surface 41 is preferably arranged near perpendicular to the propagating light beam in the optical waveguide 2, at the extremity E of the second portion 2B of the optical waveguide as illustrated in FIG. 1*a* but may also be realized to the incident light side, or to the side opposite to it, of the optical waveguide 2, and located substantially near the extremity E of the optical waveguide 2, as illustrated in FIG. 2*a*. In a variant, at least two outcoupling surfaces 41 may be arranged at the outcoupling extremity E of the optical waveguide and at least one of the outcoupling surfaces 41 may comprise a metallic or dielectric reflecting structure.

In the generic embodiment illustrated in FIG. 1*a*, the optical waveguide 2 of the tamper seal 1 is designed to be disrupted, broken, partially destroyed or irreversibly deformed at a portion 200 of the optical waveguide 2 when said two parts of said object, to which the tamper seal 1 is arranged, undergo a relative displacement. It may also happen that the optical waveguide 2 of the tamper seal 1 is locally destroyed for instance by using a tool or by any other means. The mechanical resistance of the optical waveguide 2 may be designed by advantageously choosing the materials or also by incorporating a weak mechanical portion of the optical waveguide 2, for instance by partially scribing the optical waveguide or by arranging the optical waveguide 2 in different portions, which may have each different optical guidance properties comprising at least one portion having a weaker mechanical resistance. The optical waveguide 2 may also comprise at least one portion of which the optical guidance and transmission properties are changed by a heat sensitive portion. Upon heating this portion the transmitted colours, modes or intensity of the guided light is changed so that the intensity, colour and/or polarisation of the out-coupled light is altered. This may be an interesting feature in the tamper seal as heating is one of the methods used by counterfeiters in trying to remove the tamper seal, for example in situations wherein the tamper seal is protected by a plastic sleeve or in the case that the adhesives used to arranged in on the object can be more easily delaminated upon heating. The at least partial disruption, partial damage or breakage of the optical waveguide 2 will interrupt the light guided in the optical waveguide at the portion 200 and will be easily observed as it will lead to a change of the intensity and/or colour of the light decoupled by the out-coupling surface of the optical waveguide 2. An optical waveguide 2, in a similar way to an electrical waveguide or conductive wire, is sensitive to perturbations occurring over its whole propagation length, so that disruption or breakage of the optical waveguide 2 may occur at any place along the optical waveguide and produce substantially the same optical effects, detectable at said outcoupling surface of the optical waveguide.

It is generally admitted that re-establishing a good quality optical contact in a broken optical waveguide is very difficult. It usually requires specific equipment and the operation is very time-consuming, requiring also a highly skilled and trained person. The technology involved in the fabrication of the optical waveguide 2 and especially the input coupler requires a significant and expensive technological infrastructure and therefore the fabrication process is difficult to forge. These extremely high investment costs are a barrier for counterfeiters as the tamper seal such as described is very difficult to duplicate.

The irreversible loss of optical transmission quality in the optical waveguide 2 can be made very obviously by a specific design and engineering of the input coupler, the optical waveguide 2 and the combination of both. More precisely, the sensitivity of the detection of any disruption or perturbation of the optical waveguide 2 can be considerably enhanced by appropriate design of the input coupler 3 of the tamper seal. The applicant has filed an application PCT/EP2013/065631 describing the design, the method of realization and the obtained transmission and high efficient light coupling characteristics of an input coupler 3. The grating structures taught in PCT/EP2013/065631 can be adapted directly to the input coupler 3 of the tamper seal of the present invention. Examples of grating structures that can be adapted as an input coupler 3 structure are disclosed in the patents EP1767964 and EP1990661 and may be realized by any grating fabrication method adapted to plastic foils. In the application PCT/EP2013/065631, a rigorous simulation and optimization method is disclosed, proposing a grating coupler to which an enhancement layer is arranged. By advantageously choosing the profile of the grating elements and the appropriate enhancement layer of the input coupler, highly efficient input couplers can be devised and produced at low cost. According to the application PCT/EP2013/065631, incident light on the input coupler 3 can be coupled with high efficiency in a flexible foil or in a flexible ribbon. Moreover, laser beam can be transmitted by such couplers without losing their collimation. The manufacturing process costs of these input couplers are very low and allow manufacturing low cost tamper seals.

In a variant of the generic embodiment, intended to enhance the optical effect of an induced irreversible partial loss upon at least partial disruption of the optical waveguide, the input coupler 3 and the optical waveguide 2 are designed so that specific colours and/or guided modes are prevented from propagation in the optical waveguide, so that only specific colours or modes are transmitted by the optical waveguide. Upon at least partial rupture of the optical waveguide 2, light incident laterally on the breakage or disruption portion 200 of the optical waveguide 2 may incouple specific colours or modes, which can be easily detected by observing the light outcoupled at the edge of the optical waveguide 2. According to a variant, said specific colours and/or modes are attenuated by design in said optical waveguide. In still another variant, the tamper seal can be arranged so that unwanted guided light is outcoupled under an angle different than the outcoupling angle at the edge of an intact optical waveguide 2. According to another variant, the optical waveguide 2 may comprise at least two outcoupling surfaces 41 to couple light out of the optical waveguide. In yet another variant, at least two different edges may be arranged at the outcoupling surface of the optical waveguide, so that the light leaves the optical waveguide along two substantially different directions. When the optical waveguide is at least partially disrupted at least one of the outcoupled beams undergo a change in colour and/or intensity and/or polarisation.

Figure 1B:
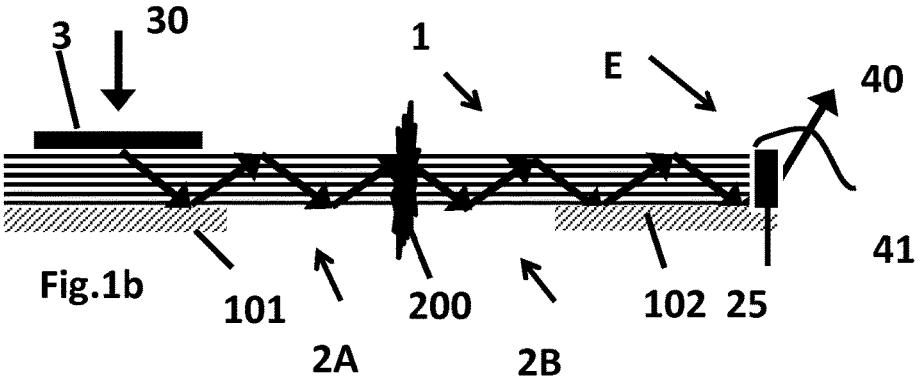
FIG. 1*b* illustrates a lateral view of the generic tamper seal comprising a first layer arranged on the outcoupling surface.
Figure 1C:
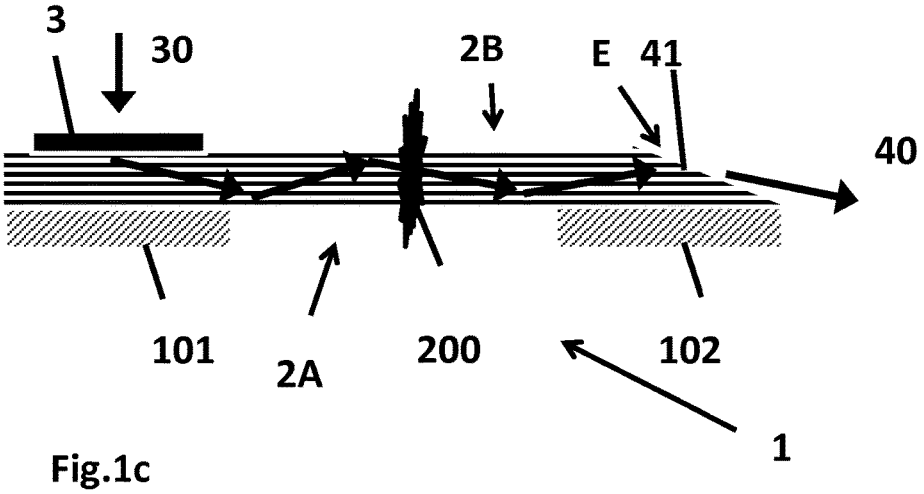
FIG. 1*c* illustrates a lateral view of the generic tamper seal comprising a wedged outcoupling surface where light is outcoupled.

In still another variant, illustrated in FIG. 1*b* at least a first layer 25 may be arranged on said outcoupling surface 41 of the optical waveguide 2, said first layer 25 being intended to interact with the transmitted light by the optical waveguide 2 incident on the outcoupling surface 41, said first layer 25 being further sensitive to any change of the transmitted lightbeam in the optical waveguide, for example a change of colour or a change of intensity and/or polarisation. Said at least first layer 25 may be an ink, a coloured layer, or any type of a fluorescent or phosphorescent material. Said first layer 25 may be arranged on only a portion of the outcoupling surface 31 of the waveguide. Said first layer 25 may comprise a security element, preferably a zero order filer or a hologram or any type of grating structure comprising grating elements, or any type of nanostructure. As an example, the first layer may show a logo, a symbol or a text, which may be altered by any disruption of the optical waveguide 2. Said first layer 25 may be arranged on different portions of the outcoupling surface 41 of the optical waveguide 2.

According to an embodiment illustrated in FIG. 1*d*, the optical waveguide 2 of the tamper seal 1 may comprise a cladding 20, also called cladding layer 20, arranged to at least one portion of the surface of the optical waveguide. The cladding may be arranged periodically on the optical waveguide 2 surface. The material of the cladding 20 is chosen to have a refractive index lower than the refractive index of the optical waveguide 2. In a variant the optical waveguide 2 may comprise at least two cladding layers 20, 22 arranged each on at least a portion of the optical waveguide 2.

According to an embodiment illustrated in FIG. 1*e*, at least a second layer 26 is arranged on at least a portion of the optical waveguide 2 and/or its out-coupling surface. This first layer 26 can change the light propagating property of the optical waveguide 2 by containing scattering elements, surface roughness or structures, absorbing elements or fluorescent or phosphorescent elements. These elements and/or surface features will change the light output of the waveguide by removing some modes or colours and/or adding some colours in the case of fluorescent or phosphorescent materials. Some of these elements or surface features may be incorporated into the optical waveguide 2, for example in the case of a polymer optical waveguide 2 by mixing the elements with the polymer matrix. These elements are preferably arranged in specific locations, such as after the input coupler 3, before the outcoupling surface 41, along the whole wavelength or periodically to select mode or colours that can propagate in the optical waveguide 2.

In a further embodiment of the invention, illustrated in FIG. 1*f*, at least a first layer 25 is arranged on at least a portion of the optical waveguide 2. This first layer is designed at enhancing the out-coupling of the light from the waveguide, or of changing its appearance, especially colour, angular distribution to make the out-coupling surface distinctive. This first layer can contain security elements creating a visually distinct appearance. The light transported in the optical waveguide 2 can be invisible to human eye, especially in the range of ultraviolet and infrared wavelengths and the first layer 25 can make the light visible to human eye, by comprising UV pigments such as fluorescent molecules or infrared pigments.

In a further embodiment, the input coupler 3 is designed to couple light at least partially into a cladding layer of the optical waveguide 2, and at least one second layer 26 comprising a security element 26 is arranged on the optical waveguide 2. In such an embodiment, any rupture of the cladding of the optical waveguide 2 will alter the luminosity or colour of said security element.

The optical waveguide 2 of the generic embodiment, illustrated in FIGS. 1*a-f*, may be any optical waveguide, for example a fiber ribbon comprising a plurality of multimode fibers, possibly arranged as a substantially flat multifiber ribbon. The fibers may also be arranged so that the arrangement has a substantially circular cross section. In the case of a multifiber arrangement, the ribbon may be fused at its extremities so as to allow arranging an input coupler to one of its fused extremities and an outcoupling surface on the other fused extremity E. For example, in the case wherein the optical waveguide 2 is an optical waveguide comprising a plurality of optical waveguides, such as a fiber bundle comprising a plurality of optical fibers, said first layer 25 may be arranged on the outcoupling surface of one of the fibers of said fiber bundle.

A great number of varieties can be devised to realize optical waveguides such as fiber bundles, in glass and/or plastic, as well as the techniques to align, assemble, polish and adapt the extremities of these optical waveguides 2 and/or bundles to specific shapes and geometries. These have been disclosed widely in the literature and will not be further explained herein. Some examples can be found in U.S. Pat. No. 3,514,351, U.S. Pat. No. 3,236,710, JP 19780126315.

In order to check the integrity of the tamper seal 1 according to the invention, at least one light source is necessary and the observation of the outcoupled light is required, preferably by a human eye, or by any light detection means sensitive to colour and/or intensity. The light source that directs light onto said input coupler may be any light source, for example a fixed light source or a mobile light source such as the light source from a pocket lamp, the light source from a smartphone duly equipped, a pocket lamp of some sort, a laser pointer, or any light source in the immediate environment of the object to which the tamper seal is arranged. Additional readout equipment may be useful for further control as the tamper seal of the invention may be designed advantageously to be combined with other security elements which may be optical, electronic or mechanical. Said readout equipment for example may comprise an analyser to detect the polarisation state of the outcoupled light beam.

In an exemplary realization, a white light LED providing a divergent white light beam may be directed on a 3 mm×3 mm sized incoupler arranged on a 4 mm×40 mm waveguide having a thickness of 50 um, on which a 3 mm×5 mm sized outcoupler is arranged. The angular alignment tolerance of said white light beam to the normal of the 3 mm×3 mm incoupler is typically 20°, the LED source is positioned preferably by the hand at 20 mm from said incoupler, and said incoupler, multimode waveguide and outcoupler are designed and arranged to project a green letter onto the retina of the eye or on a ccd chip of a camera facing said outcoupler. In the exemplary realization, upon at least partial disruption of the waveguide the color of the letter may not to be green any more, or may become invisible or a previously hidden texts or logo may appear showing the seal was manipulated and the protected object may not be genuine.

Another embodiment illustrated in FIG. 2*a* differs from the embodiment of FIG. 1 in that an output coupler 4 is arranged to the outcoupling surface 41 of the optical waveguide 2, and to the incident light 30 side of the optical waveguide 2. Preferably the output coupler 4 comprises a diffraction grating that couples the guided light out of the optical waveguide 2. FIG. 2*b* shows a top view of a tamper seal comprising an output coupler 4.

In another embodiment illustrated in FIG. 3, said input coupler 3 and said output coupler 4 are arranged to the side of the optical waveguide 2 opposite to the incident light beam on the optical waveguide 2. In such an embodiment the input and output couplers may comprise reflecting grating couplers.

In yet another embodiment, illustrated in FIG. 4 the output coupler 4 is arranged to the incident light side of the optical waveguide 2 and the input coupler 3 is arranged to the side of the optical waveguide 2 opposite to the incident light side. The input coupler 3 may also be arranged to the incident light side of the optical waveguide 2 while the output coupler 3 is arranged to the side of the optical waveguide 2 opposite to the incident light side.

In FIG. 5 is illustrated an embodiment wherein the input coupler 3 is arranged to the incident light side of the optical waveguide 2 and wherein the output coupler 4 is arranged to the side of the optical waveguide 2 of the incident light and is designed to outcouple light in reflection, to the opposite side of the incident light.

In FIG. 6, an embodiment is shown wherein the optical waveguide 2 comprises at least one cladding 20 and wherein an output coupler 4 is arranged on the outcoupling surface 41.

FIG. 7 shows an embodiment wherein the input coupler 3 and the output coupler 4 is imbedded in the cladding 20 of the optical waveguide 2, preferably close to the surface of the optical waveguide 2 and wherein the optical waveguide 2 comprises at least a second layer 26, substantially similar to the second layer 26 of FIG. 1*e*. In an embodiment similar to the one shown in FIG. 7 the input coupler and/or the output coupler may be imbedded in the optical guiding part, also called core, of the optical waveguide.

In another embodiment, a first layer 25, substantially similar to the first layer 25 of the preferred embodiment of FIG. 1*f*, is arranged on the output coupler 4. Said layer 25 may be arranged to the output coupler 4 in every embodiments of FIG. 2-FIG. 7.

In another embodiment, illustrated in FIG. 8*a* a second layer 26 is arranged on an optical waveguide 2 comprising a first cladding 20, and the input coupler 3 is designed to couple at least a portion of the light into the optical waveguide core. With most optical couplers and a light beam provided by a spectrally broad and non-collimated light source, some modes and/or wavelengths are expected to be incoupled into at least one of the optical waveguide claddings 20, 22. Said second layer 26 may be designed to remove specific portions or the whole light beam propagating in the optical waveguide cladding 20,22 by optical absorption or scattering or out-coupling. Especially stray light and non-desired colors or mode can be removed. According to the embodiment of FIG. 8*a*, the second layer 26 changes the intensity or the color of guided light into the cladding 20, 22 of the optical waveguide 2. Any damage to said second layer 26 will be detected by a change of the intensity or color of the out-coupled light from the waveguide core through at least one outcoupling surface 40.

In another embodiment illustrated in FIG. 8*b*, the said second layer 26 is arranged on the propagation axis of the waveguide after the light in-coupler 3. This allows removing non desired light propagation in the cladding of the optical waveguide 2. When the optical waveguide 2 is at least partially disrupted, attempts to re-establish an optical contact and a light-guiding property are expected not to rebuild a perfect core/cladding optical contact of the two partially separated optical waveguide 2 portions. After disruption and rebuild, a portion of the optical waveguide 2 is expected to let light leak out of the optical waveguide 2 core to the cladding arranged on the optical waveguide 2. This change of intensity or color of the light propagating in the wavelength core will change to some extent the intensity or color of the outcoupled light. This change will let light propagate in the cladding to the first layer 25. This first layer 25, substantially similar to the first layer 25 of the preferred embodiment of FIG. 1*f* will become visible when reached by light leaking out of the optical waveguide core. Such arrangements can be designed so that re-establishing poor optical contacts of at least partially disrupted optical waveguide 2 is very visible and lead to a distinctive appearance.

FIG. 9 illustrates the embodiment of the FIG. 8*b* from a top view. Upon disruption and poor quality rebuild of the optical guiding property of the optical waveguide 2, light is expected to be injected in the cladding and the text of first layer 25 to be visible. On the opposite, a genuine optical waveguide 2 is designed not to have light propagating in its cladding and the element 25 is not light-up. In this example a sign "OK" is visible as arranged on the output coupler 4 when the tamper seal is not damaged and a sign 45 "NOT" is visible when at least the optical waveguide 2 of the tamper seal 1 is at least partially damaged.

According to an embodiment at least two output couplers 4 are arranged on the optical waveguide 2. The at least two output couplers 4 and optical waveguides 2 may be arranged according to any combination of the embodiments of FIG. 1-10.

In another embodiment the tamper seal 1 according to the invention may comprise a plurality of input couplers 3 and output couplers 4 arranged along an optical waveguide, as illustrated in FIG. 10. Different optical waveguides 2 and different couplers may as well be integrated and a single seal for added complexity.

FIG. 11 shows an embodiment comprising a curved optical waveguide 2, comprising one input coupler 3 and two output couplers 4 arranged on the curved optical waveguide 2.

It will be obvious for the person skilled in the art that the tamper seal 1 may comprise a plurality of optical waveguides on which a plurality of input and output couplers may be arranged. Said plurality of input couplers may face each other or may be arranged so that they do not face each other. The same holds for the plurality of output couplers, i.e. output couplers may face each other or may be arranged so that they do not face each other. In an example of realization 3 multimode waveguides having each a different length are arranged parallel to each other and comprise each at a first end an input coupler and at their second end an output coupler. In such an arrangement the stack of 3 multimode waveguides comprise 3 input couplers arranged as a step and 3 output couplers arranged as another step. It will be obvious for the person skilled in the art that the at least one optical waveguide 2 of the tamper seal 1 may be further sensitive to its physical environment by engineering at least one of the couplers 3, 4 to delaminate easily from the at least one optical waveguide 2, or the at least one cladding 20, 22 from its optical waveguide 2, or the at least first 25 and second 26 layer from the optical waveguide 2 or cladding or outcoupling surface 41 where they are arranged.

The invention relates also to an object 100 comprising a first part 110 and a second part 120 movable relative to each other with said first 110 and second 120 parts being sealed by a tamper seal 1 according to the described embodiments. Some exemplary objects 100 are illustrated in FIG. 12. The object 100 to which the tamper seal 1 may be arranged may be any type of object 100 comprising at least two movable parts such as a bottle and a bottle cap. The object 100 to which the tamper seal 1 is arranged may be a container comprising a moveable cap or closure, a container box and its lid. The arrangement of the tamper seal 1 and its object 100 can be designed so that the outcoupled light 40 illuminates specific parts of the object 100 and/or can be incoupled into objects 100 at least partially transparent such as jar and bottle. Said object 100 may comprise laterally moving parts 110,120 such as doors or handles. The tamper seal 1 can also be integrated within a foil or be laminated on a foil which disruption is necessary to access or use the object 100, such as a polymer protection sheets or sleeves. In this case, the different parts of the foil or sleeve are moving relatively to each other upon disruption of the foil but can be structurally linked prior to this movement and or disruption. The person skilled in the art may devise other objects 100 to which the described tamper seal 1 may be arranged.

The embodiments of the invention in which an exclusive property or privilege is claimed are defined as follows:

1. A tamper seal comprising an optical waveguide comprising at least a first portion and a second portion configured to be respectively arranged on a first part and on a second part of an object, said first and second parts being movable relative to each other, wherein said optical waveguide is a flat and flexible multimode optical waveguide defining a plane and having, parallel to said plane, a first side and a second side opposite to said first side, said waveguide comprising at least a rectangular shaped waveguide core that has a smallest dimension, defined perpendicular to said propagation direction, greater than 10 μm and smaller than 10 mm, said first portion comprising on one of said sides an input coupler arranged to couple incident light into said optical waveguide, said second portion comprising on one of said sides at least one output coupler arranged to couple out of said optical waveguide at least partially light guided in the optical waveguide, wherein said input coupler, said optical waveguide and said output coupler are configured to transmit light from said input coupler to said output coupler, said optical waveguide being further configured to be at least partially disruptable between said first portion and said second portion, said optical waveguide comprising a layer configured to produce at said outcoupling surface a visually distinctive appearance when light is incoupled in said incoupler, said layer being further configured so that said visually distinctive appearance is changed in response to a change of the optical guiding properties of said flat multimode waveguide in response to an at least partial disruption of said optical waveguide.

2. The tamper seal according to claim 1, wherein said visually distinctive appearance is the color of the outcoupled light by said outcoupling surface.

3. The tamper seal according to claim 1, wherein said visually distinctive appearance is the angular distribution of the outcoupled light by said outcoupling surface.

4. The tamper seal according to claim 1, wherein said visually distinctive appearance is the display of a logo or a symbol or a text and in that said change of appearance is the alteration of the display of said logo or symbol or text.

5. The tamper seal according to claim 4, wherein said change of said text comprises the substitution of at least one letter by another letter in said text.

6. The tamper seal according to claim 4, wherein said optical waveguide comprises a cladding and wherein said change of said visually distinctive appearance is produced by light leaking into said cladding.

7. The tamper seal according to claim 1, wherein the optical waveguide is made of polymer or glass or made in a water soluble polymer.

8. The tamper seal according to claim 1, wherein the optical waveguide comprises a portion of which the waveguiding properties are irreversibly altered by heat.

9. The tamper seal according to claim 1, wherein at least one of said input coupler or outcoupling surface comprises a water soluble polymer.

10. The tamper seal according to claim 1, wherein a second layer is arranged on at least a portion of said waveguide, said second layer being configured to enhance the sensitivity of the optical effect of the change of said visual distinctive appearance.

11. The tamper seal according to claim 10, wherein said second layer comprises at least one of an ink layer, a fluorescent layer, a phosphorescent layer, a colored layer comprising any type of pigment, an ultraviolet pigment, an infrared pigment, an optical scattering layer or a refractive optical element.

12. The tamper seal according to claim 10, wherein said second layer is incorporated into said optical waveguide.

13. The tamper seal according to claim 1, wherein at least one optical security element is arranged on at least a portion of said optical waveguide.

14. The tamper seal according to claim 13, wherein at least one optical security element is arranged on said output coupler.

15. The tamper seal according to claim 13, wherein the at least one optical security element comprises at least one of: a hologram, a zero order filter, a microlens array, a microprism array, a moiré effect device.

16. The tamper seal according to claim 1, wherein the input coupler and/or the output coupler is a diffractive coupler configured to diffract light according a first order of diffraction or a second order of diffraction.

17. The tamper seal according to claim 1, wherein said first and second portions are separated by a disruptable portion of the optical waveguide, a mechanical resistance of the disruptable portion being lower than a mechanical resistance of the first portion and a mechanical resistance of the second portion.

18. The tamper seal according to claim 1, wherein at least two outcoupling surfaces are arranged on the optical waveguide.

19. The tamper seal according to claim 1, wherein the optical waveguide comprises at least two separate optical waveguides arranged to an incoupling grating.

20. An object comprising a first part and a second part movable relative to each other, said first and second parts being sealed by the tamper seal according to claim 1, said first part and second parts being each integral with, respectively, first and second portions of the optical waveguide of said tamper seal, so that a displacement of the first and second parts of the object generates at least a partial disruption of the optical waveguide.

21. The object according to claim 20, wherein the object is a bottle and wherein said first part is a bottle and the second part is preferably the bottle cap, more preferably the cork, and further wherein the said first portion of the optical waveguide is arranged on said bottle and wherein the second portion of the optical waveguide is arranged on said bottle cap.

* * * * *